US007840149B2

(12) United States Patent
Kamprath et al.

(10) Patent No.: US 7,840,149 B2
(45) Date of Patent: Nov. 23, 2010

(54) ENHANCING IMAGE PERMANENCE BY FUSING MEDIA MULTIPLE TIMES

(75) Inventors: David J. Kamprath, Webster, NY (US); Michael Elter, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 281 days.

(21) Appl. No.: 12/183,705

(22) Filed: Jul. 31, 2008

(65) Prior Publication Data

US 2010/0028063 A1 Feb. 4, 2010

(51) Int. Cl.
*G03G 15/20* (2006.01)

(52) U.S. Cl. ..... 399/67

(58) Field of Classification Search ..... 399/400, 399/401, 67, 68, 320, 341
See application file for complete search history.

(56) References Cited

U.S. PATENT DOCUMENTS 4,131,360 A * 12/1978 O'Brien
4,167,323 A * 9/1979 Hage
4,699,503 A * 10/1987 Hyltoft ..... 399/401
5,142,340 A * 8/1992 Farrell et al.
6,271,870 B1 * 8/2001 Jacob et al. ..... 399/67
6,996,362 B2 * 2/2006 Kellie et al.
7,343,130 B2 * 3/2008 Nakayama
2008/0187375 A1 * 8/2008 Tomizawa ..... 399/341

FOREIGN PATENT DOCUMENTS

JP 08234620 A * 9/1996
JP 2001318548 A * 11/2001
JP 2003149979 A * 5/2003
JP 2003263087 A * 9/2003
JP 2005258209 A * 9/2005
JP 2007065328 A * 3/2007

* cited by examiner

*Primary Examiner*—Susan S Lee
(74) *Attorney, Agent, or Firm*—Ronald E. Prass, Jr.; Prass LLP

(57) ABSTRACT

According to various illustrative embodiments, a system and method for enhancing image permanence are described. In one aspect, the method includes applying an image to a sheet of a medium using a system including at least one photoreceptor, at least one fuser, at least one inverter, and at least one duplex path loop operatively connecting an output of the at least one fuser with an input to the at least one photoreceptor. The method also includes fusing the sheet of the medium at least twice using the at least one fuser before any other image is applied to the sheet of the medium.

20 Claims, 3 Drawing Sheets

ENHANCING IMAGE PERMANENCE BY FUSING MEDIA MULTIPLE TIMES

BACKGROUND

The present disclosure relates generally to enhancing image permanence in imaging systems. More particularly, the present disclosure describes a system and method useful for enhancing image permanence for difficult media in imaging systems.

Fusing requirements in imaging systems such as copiers and/or printers vary significantly for different papers and throughput media. A fusing system designed to handle the most difficult papers, such as preprinted paper and/or very heavy and/or rough paper, would cost significantly more and occupy more space than a system designed to handle the easier 90% of papers. Previous methods of addressing this problem have included running the fuser slower for difficult papers and/or increasing the fuser temperature. However, running the fuser more slowly requires more complicated software implementation and/or may require drive system changes for multiple subsystems. Moreover, increasing the fuser temperature may lead to limited improvement opportunities and/or may result in reduced component life.

SUMMARY

According to various illustrative embodiments, a system and method for enhancing image permanence are described. In one aspect, the method comprises applying an image to a sheet of a medium using a system comprising at least one photoreceptor, at least one fuser, at least one inverter, and at least one duplex path loop operatively connecting an output of the at least one fuser with an input to the at least one photoreceptor. The method also comprises fusing the sheet of the medium at least twice using the at least one fuser before any other image is applied to the sheet of the medium.

BRIEF DESCRIPTION OF THE DRAWINGS

The following figures form part of the present specification and are included to further demonstrate certain aspects of the subject matter, and should not be used to limit or define the subject matter. The subject matter may be better understood by reference to one or more of these drawings in combination with the description of embodiments presented herein. Consequently, a more complete understanding of the present embodiments and further features and advantages thereof may be acquired by referring to the following description taken in conjunction with the accompanying drawings, in which the leftmost significant digit(s) in the reference numerals denote(s) the first figure in which the respective reference numerals appear, wherein.

It is to be noted, however, that the appended drawings illustrate only typical embodiments of the present subject matter and are, therefore, not to be considered limiting of the scope of the subject matter, as the subject matter may admit to other equally effective embodiments.

DETAILED DESCRIPTION

Illustrative embodiments of the subject matter are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

Figure 1:
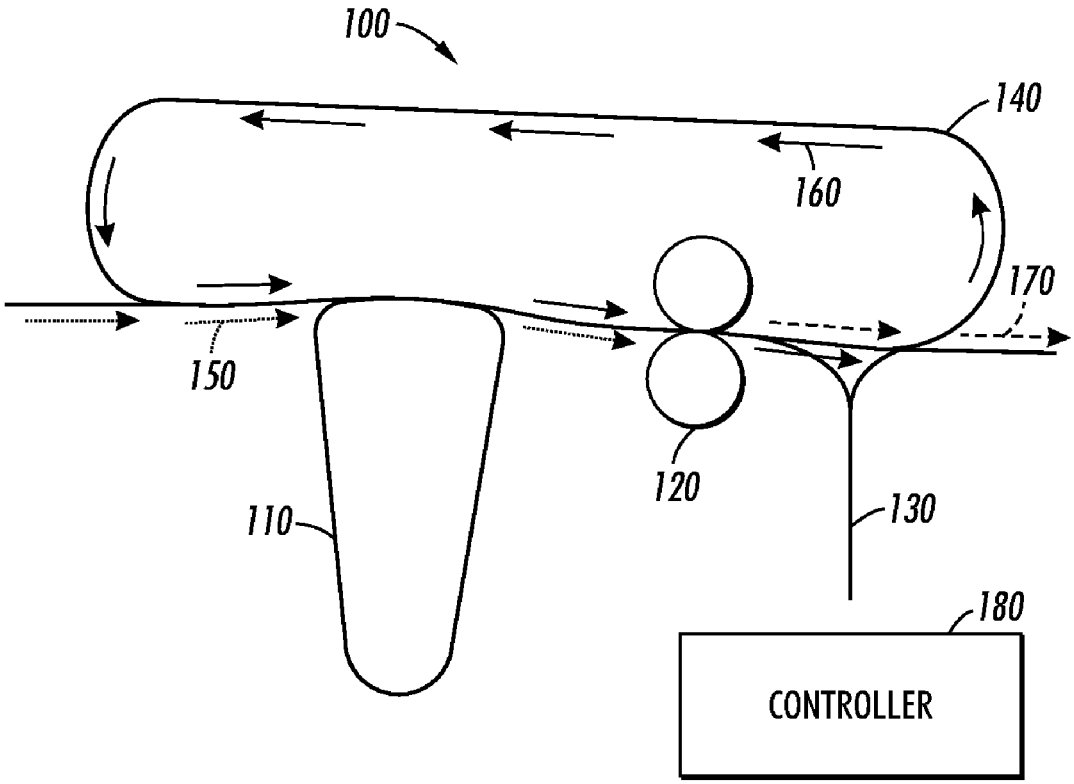
FIG. 1 schematically illustrates a particular example of various illustrative embodiments of a system in accord with the present disclosure.

In various illustrative embodiments, as shown in FIG. 1, for example, a system 100 for enhancing image permanence may include at least one photoreceptor 110 arranged to apply an image to a sheet of a medium 150. The system 100 may also include at least one fuser 120 arranged to fuse the sheet of the medium 150, 160. As shown in FIG. 1, for example, the sheet of the medium 150 enters the system 100, the sheet of the medium 160 has passed through the at least one fuser 120, and the sheet of the medium 170 exits the system 100. The system 100 may also include at least one inverter 130 arranged to invert the sheet of the medium 160. The system 100 may also include a controller 180 arranged to control the at least one photoreceptor 110, the at least one fuser 120, and the at least one inverter 130 to fuse the sheet of the medium twice using the at least one fuser 120 either before any other image is applied to the sheet of the medium 160 or after applying a preselected secondary image to the sheet of the medium 150. In various illustrative embodiments, as shown in FIG. 1, for example, the system 100 for enhancing image permanence may further include at least one duplex path loop 140 operatively connecting an output of the at least one fuser 120 with an input to the at least one photoreceptor 110.

Figure 2:
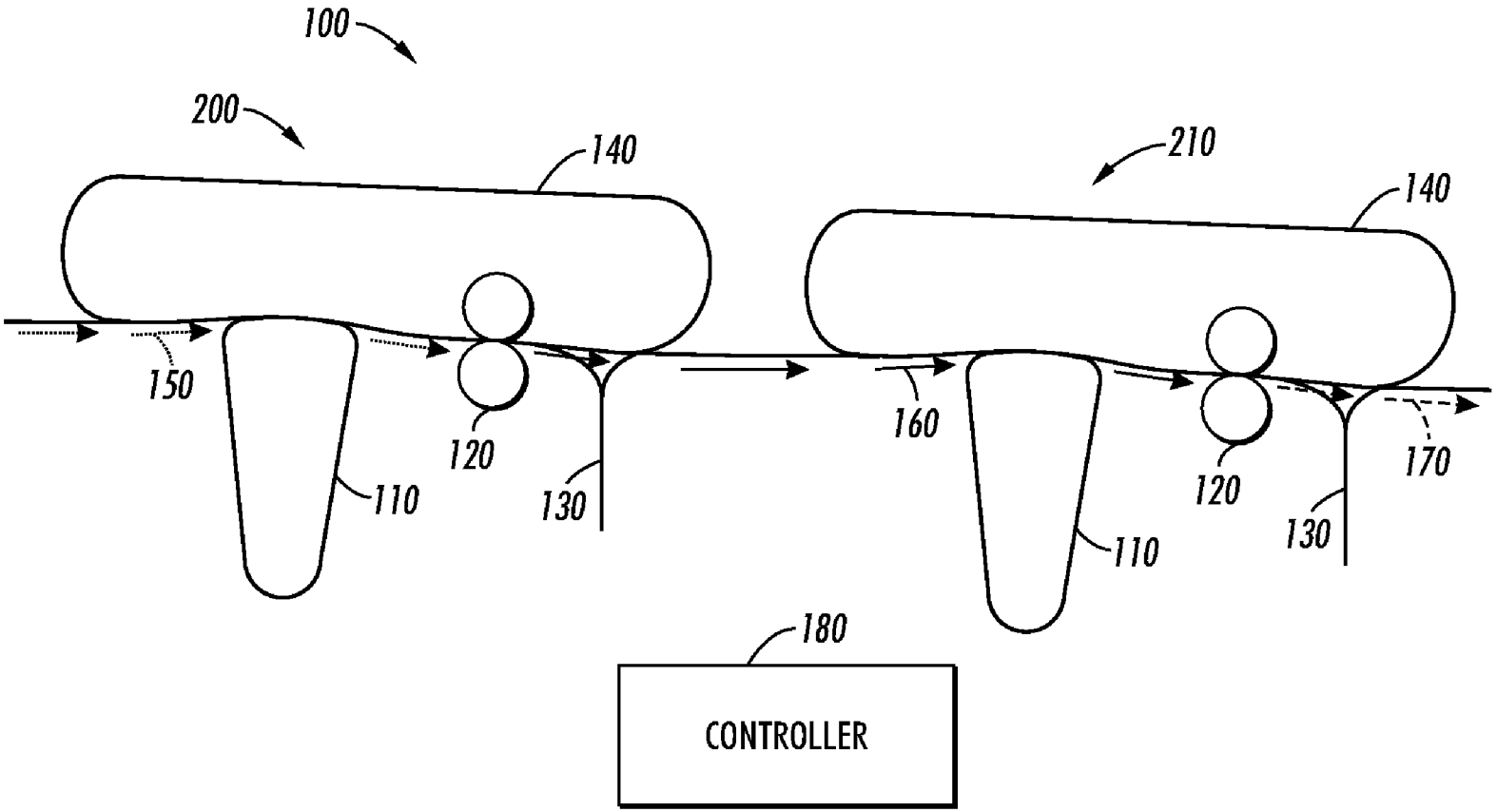
FIG. 2 schematically illustrates another particular example of various illustrative embodiments of a system in accord with the present disclosure.

In various illustrative embodiments, as shown in FIG. 2, for example, the system 100 for enhancing image permanence may include at least two photoreceptors 110 arranged to apply an image to the sheet of the medium 150, 160. The system 100 may also include at least two fusers 120 arranged to fuse the sheet of the medium 150, 160. As shown in FIG. 2, for example, the sheet of the medium 150 enters the system 100, the sheet of the medium 160 has passed through one of the at least two fusers 120, and the sheet of the medium 170 exits the system 100. The system 100 may also include at least one inverter 130 arranged to invert the sheet of the medium 160. The system 100 may also include a controller 180 arranged to control the at least two photoreceptors 110, the at least two fusers 120, and the at least one inverter 130 to fuse the sheet of the medium twice using the at least two fusers 120 either before any other image is applied to the sheet of the medium 160 or after applying a preselected secondary image to the sheet of the medium 150.

Figure 3:
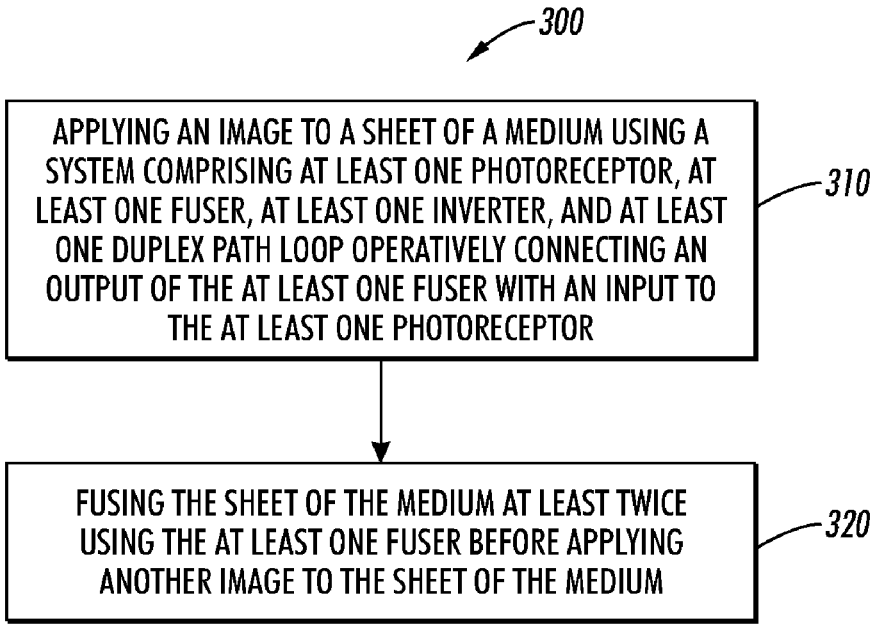
FIG. 3 schematically illustrates a particular example of various illustrative embodiments of a method in accord with the present disclosure.

FIG. 3 schematically illustrates a particular example of various illustrative embodiments of a method 300 useful for enhancing image permanence, in accord with the present disclosure. The method 300 includes applying an image to the sheet of the medium 150 using the system 100 including at least one photoreceptor 110, at least one fuser 120, at least one inverter 130, and at least one duplex path loop 140 operatively connecting an output of the at least one fuser 120 with an input to the at least one photoreceptor 110, as shown at 310. The method 300 also includes fusing the sheet of the medium 150, 160 at least twice using the at least one fuser 120 before any other image is applied to the sheet of the medium 160, as shown at 320.

In various illustrative embodiments, applying the image to the sheet of the medium 150, as shown at 310, further includes applying the image to the sheet of the medium 150 using the at least one photoreceptor 110 before fusing the sheet of the medium 150 using the at least one fuser 120. In these illustrative embodiments, after fusing the sheet of the medium 150 using the at least one fuser 120, the sheet of the medium 160 is not inverted by bypassing the at least one inverter 130. In these illustrative embodiments, after bypassing the at least one inverter 130, the image is not applied again to the sheet of the medium 160 by the at least one photoreceptor 110 before fusing the sheet of the medium 160 again using the at least one fuser 120. In these illustrative embodiments, as shown in FIG. 1, for example, the at least one duplex path loop 140 is used to convey the sheet of the medium 160 to the at least one fuser 120. In these illustrative embodiments, after having been fused twice, the sheet of the medium 170 exits the system 100. In alternative illustrative embodiments, as shown in FIG. 2, for example, the at least one duplex path loop 140 is not used to convey the sheet of the medium 160 to the at least one fuser 120. In these alternative illustrative embodiments, after having been fused twice, the sheet of the medium 170 exits the system 100.

In various illustrative embodiments, applying the image to the sheet of the medium 160, as shown at 310, further includes applying the image to the sheet of the medium 160 using the at least one photoreceptor 110 after fusing the sheet of the medium 150 using the at least one fuser 120. In these illustrative embodiments, after fusing the sheet of the medium 150 using the at least one fuser 120, the sheet of the medium 160 is inverted using the at least one inverter 130. In these illustrative embodiments, after using the at least one inverter 130, the image is applied to the sheet of the medium 160 by the at least one photoreceptor 110 before fusing the sheet of the medium 160 again using the at least one fuser 120. In these illustrative embodiments, as shown in FIG. 1, for example, the at least one duplex path loop 140 is used to convey the sheet of the medium 160 to the at least one fuser 120. In these illustrative embodiments, after having been fused twice, the sheet of the medium 170 exits the system 100.

Figure 4:
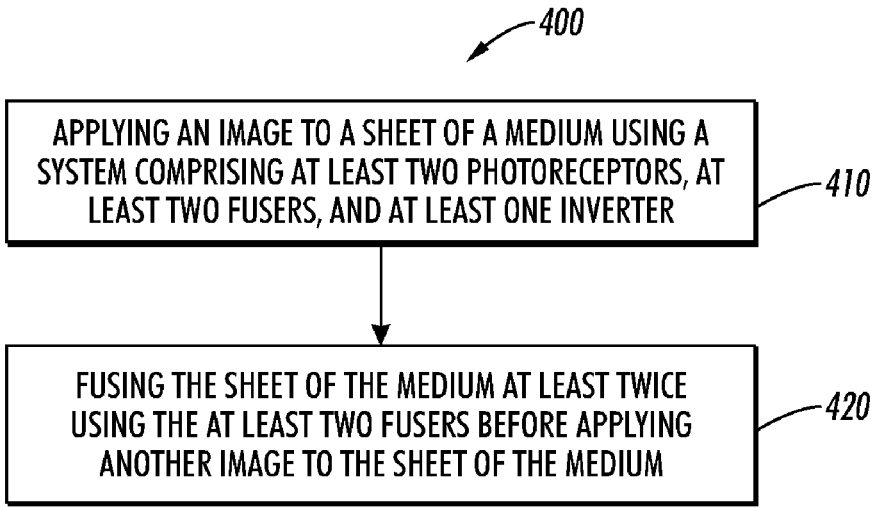
FIG. 4 schematically illustrates another particular example of various illustrative embodiments of a method in accord with the present disclosure.

FIG. 4 schematically illustrates a particular example of various illustrative embodiments of a method 400 useful for enhancing image permanence, in accord with the present disclosure. The method 400 includes applying an image to a sheet of a medium using a system 100, as shown in FIG. 2, for example, including at least two photoreceptors 110, at least two fusers 120, and at least one inverter 130, as shown at 410. The method 400 also includes fusing the sheet of the medium 150, 160 at least twice using the at least two fusers 120 before any other image is applied to the sheet of the medium 160, as shown at 420.

In various illustrative embodiments, applying the image to the sheet of the medium 150, as shown at 410, further includes applying the image to the sheet of the medium 150 using one of the at least two photoreceptors 110 before fusing the sheet of the medium 150 using either of the at least two fusers 120. In these illustrative embodiments, after fusing the sheet of the medium 150 using one of the at least two fusers 120, the sheet of the medium 160 is not inverted by bypassing the at least one inverter 130. In these illustrative embodiments, after bypassing the at least one inverter 130, the image is not applied again to the sheet of the medium 160 by either of the at least two photoreceptors 110 before fusing the sheet of the medium 160 again using one of the at least two fusers 120. In these illustrative embodiments, after having been fused twice, the sheet of the medium 170 exits the system 100.

In various illustrative embodiments, applying the image to the sheet of the medium 160, as shown at 410, further includes applying the image to the sheet of the medium 160 using one of the at least two photoreceptors 110 after fusing the sheet of the medium 150 using either of the at least two fusers 120. In these illustrative embodiments, after fusing the sheet of the medium 150 using one of the at least two fusers 120, the sheet of the medium 160 is not inverted by bypassing the at least one inverter 130. In these illustrative embodiments, after bypassing the at least one inverter 130, the image is applied to the sheet of the medium 160 by either of the at least two photoreceptors 110 before fusing the sheet of the medium 160 again using one of the at least two fusers 120. In these illustrative embodiments, after having been fused twice, the sheet of the medium 170 exits the system 100.

In various illustrative embodiments, applying the image to the sheet of the medium 160, as shown at 410, further includes applying the image to the sheet of the medium 160 using one of the at least two photoreceptors 110 after fusing the sheet of the medium 150 using either of the at least two fusers 120. In these illustrative embodiments, after fusing the sheet of the medium 150 using one of the at least two fusers 120, the sheet of the medium 160 is inverted using the at least one inverter 130. In these illustrative embodiments, after using the at least one inverter 130, the image is applied to the sheet of the medium 160 by either of the at least two photoreceptors 110 before fusing the sheet of the medium 160 again using one of the at least two fusers 120. In these illustrative embodiments, after having been fused twice, the sheet of the medium 170 exits the system 100.

In various illustrative embodiments, image permanence on difficult papers, such as preprinted paper and/or very heavy, rough paper, may be enhanced and improved by passing the paper through the fuser 120 twice. As shown in FIG. 1, for example, this may be accomplished by running the machine, such as a copier and/or a printer, including the system 100, in a special mode that may use the machine's duplex path loop 140 without inverting the sheet 160. A bypass of the inverter 130 may already be present in the machine hardware so that the non-inversion of the sheet 160 may be implemented in the software for the machine and/or controlled by the controller 180. The image may be applied to the sheet 150 by the photoreceptor 110 on the first pass through the system 100. No image may be applied by the photoreceptor 110 to the sheet 160 on the second pass through the system 100. The non-printing of the sheet 160 on the second pass may also be implemented in the software for the machine and/or controlled by the controller 180. The image side of the sheet 150, 160 may be against the fuser 120 roll in both passes through the system 100, which may double the dwell time in the fuser 120 nip. There may be some cooling between the two passes through the fuser 120 of the system 100, but the image permanence on the resulting sheet 170 may be significantly enhanced and improved relative to a simplex copy and/or print that only goes through the fuser 120 once. This special mode may not be intended to be the machine's primary operating mode. Nevertheless, this special mode may allow the machine to run special jobs without any change to the machine hardware.

In alternative illustrative embodiments, another special mode may also use the machine's duplex path loop 140 without inverting the sheet 160. However, no image may be applied to the sheet 150 by the photoreceptor 110 on the first pass through the system 100. The image may be applied by the photoreceptor 110 to the sheet 160 on the second pass through the system 100. There may again be some cooling between the two passes through the fuser 120 of the system 100, but the image permanence on the resulting sheet 170 may still be measurably enhanced and improved relative to a simplex copy and/or print that only goes through the fuser 120 once.

In various illustrative embodiments, as shown in FIG. 2, for example, the system 100 may include a tandem or TIPP architecture with two print engines 200, 210 connected in series, such as in the Nuvera 288 of Xerox. Such an architecture may be optimized to print duplex jobs with one side of the sheet printed in the first print engine 200 and the second side of the sheet printed in the second print engine 210. However, such an architecture may also provide improved and enhanced image permanence on difficult papers by running in a special mode that may not invert the sheet 160 in the inverter 130 between the print engines 200, 210 and that may not apply an image to the sheet 160 using the photoreceptor 110 in the second print engine 210. The image side of the sheet 150, 160 may be against the fuser 120 rolls twice in the system 100, which may double the dwell time in the fuser 120 nips. There may be some cooling between the two fusers 120 of the system 100, but the image permanence on the resulting sheet 170 may be significantly enhanced and improved relative to a simplex copy and/or print that only goes through a fuser 120 once. This special mode may not be intended to be the machine's primary operating mode. Nevertheless, this special mode may allow the machine to run special jobs without any change to the machine hardware.

In alternative illustrative embodiments, another special mode may not apply an image to the sheet 160 using the photoreceptor 110 in the first print engine 200, may also not invert the sheet 160 in the inverter 130 between the print engines 200, 210, and may apply an image to the sheet 160 using the photoreceptor 110 in the second print engine 210. There may again be some cooling between the two fusers 120 of the system 100, but the image permanence on the resulting sheet 170 may still be measurably enhanced and improved relative to a simplex copy and/or print that only goes through a fuser 120 once.

In still other alternative illustrative embodiments, yet another special mode may not apply an image to the sheet 160 using the photoreceptor 110 in the first print engine 200, but may invert the sheet 160 in the inverter 130 between the print engines 200, 210, and may apply an image to the inverted sheet 160 using the photoreceptor 110 in the second print engine 210. There may again be some cooling between the two fusers 120 of the system 100, but the image permanence on the resulting sheet 170 may still be measurably enhanced and improved relative to a simplex copy and/or print that only goes through a fuser 120 once.

In various illustrative embodiments, image permanence on difficult papers, such as preprinted paper and/or very heavy, rough paper, may be enhanced and improved by passing the paper through the fuser 120 twice even when it is difficult to run sheets through the duplex path loop 140 without inverting them. As shown in FIG. 1, for example, this may be accomplished by running the machine, such as a copier and/or a printer, including the system 100, in another special mode that may use the machine's duplex path loop 140 with inversion of the sheet 160. No image may be applied to the sheet 150 by the photoreceptor 110 on the first pass through the system 100. The sheet 160, after passing once through the fuser 120, may be inverted using the inverter 130 and may run through the duplex path loop 140. The image may be applied by the photoreceptor 110 to the sheet 160 on the second pass through the system 100 and the sheet 160 passes through the fuser 120 again. The non-printing of the sheet 160 on the first pass and the printing of the sheet 160 on the second pass may be implemented in the software for the machine and/or controlled by the controller 180. No fusing takes place on the first pass through the fuser 120, but the paper is pre-heated so that a higher temperature may be achieved during the second pass through the fuser 120 and the image permanence on the resulting sheet 170 may still be measurably enhanced and improved relative to a simplex copy and/or print that only goes through a fuser 120 once. This special mode may not be intended to be the machine's primary operating mode. Nevertheless, this special mode may allow the machine to run special jobs without any change to the machine hardware.

In various illustrative embodiments, image permanence on difficult papers, such as preprinted paper and/or very heavy, rough paper, may be enhanced and improved by passing the paper through the fuser 120 twice in duplex printing where the image on one side of the paper is primary or more important and/or critical than the secondary or less important and/or less critical image on the other side of the paper. The primary image may be preselected by the operator, which means that the secondary image may also be preselected. As shown in FIG. 1, for example, this may be accomplished by running the machine, such as a copier and/or a printer, including the system 100, in another special mode that may use the machine's duplex path 140 with inversion of the sheet 160. The preselected secondary image may be applied to the sheet 150 by the photoreceptor 110 on the first pass through the system 100. The sheet 160, after passing once through the fuser 120, may be inverted using the inverter 130 and may run through the duplex path loop 140. The primary image may then be applied by the photoreceptor 110 to the sheet 160 on the second pass through the system 100 and the sheet 160 passes through the fuser 120 again. The preselection of the secondary image for printing on the sheet 150 on the first pass and the printing of the primary image on the sheet 160 on the second pass may be implemented in the software for the machine and/or under the control of the controller 180. Fusing of the preselected secondary image takes place on the first pass through the fuser 120, and the paper is pre-heated so that a higher temperature may be achieved during the second pass through the fuser 120 and the image permanence on the resulting sheet 170 may still be measurably enhanced and improved relative to a simplex copy and/or print that only goes through a fuser 120 once. This special mode may not be intended to be the machine's primary operating mode. Nevertheless, this special mode may allow the machine to run special jobs without any change to the machine hardware.

Similarly, in various illustrative embodiments, image permanence on difficult papers, such as preprinted paper and/or very heavy, rough paper, may be enhanced and improved by passing the paper through the fuser 120 twice in duplex printing using the tandem or TIPP architecture where the image on one side of the paper is more important and/or critical than the secondary image on the other side of the paper. The primary image may be preselected by the operator, which means that the secondary image may also be preselected. As shown in FIG. 2, for example, this may be accomplished by running the machine, such as a copier and/or a printer, including the system 100, in another special mode that may use the machine's two print engines 200, 210 with inversion of the sheet 160. The preselected secondary image may be applied to the sheet 150 by the photoreceptor 110 of the first print engine 200. The sheet 160, after passing through the fuser 120 of the first print engine 200, may be inverted using the inverter 130. The primary image may then be applied by the photoreceptor 110 of the second print engine 210 to the sheet 160 and the sheet 160 passes through the fuser 120 of the second print engine 210. The preselection of the secondary image for printing on the sheet 150 in the first print engine 200 and the printing of the primary image on the sheet 160 in the second print engine 210 may be implemented in the software for the machine and/or under the control of the controller 180. Fusing of the preselected secondary image takes place on passing through the fuser 120 of the first print engine 200 and the paper is pre-heated so that a higher temperature may be achieved while passing through the fuser 120 of the second print engine 210 and the image permanence on the resulting sheet 170 may still be measurably enhanced and improved relative to a simplex copy and/or print that only goes through a fuser 120 once. This special mode may not be intended to be the machine's primary operating mode. Nevertheless, this special mode may allow the machine to run special jobs without any change to the machine hardware.

In various illustrative embodiments, various of the special modes described above may be usefully combined together, as would be readily apparent to those of skill in the art having the benefit of the present disclosure. For example, as shown in FIG. 2, when both print engines 200, 210 have duplex path loops 140, each print engine 200, 210 may be run in the special mode where the sheet of the medium 160 passes through the fuser 120 of each print engine 200, 210 twice using each duplex path loop 140, with inversion in the inverter 130 between the print engines 200, 210, resulting in enhanced image permanence duplex printing of the sheet of the medium 170.

In accordance with the present disclosure, an apparatus, system, and method useful for enhancing image permanence are disclosed. In various aspects, an apparatus in accordance with the present disclosure may include means for enhancing image permanence and means for enabling the means for enhancing image permanence, both the means for enhancing image permanence and the means for enabling the means for enhancing image permanence covering corresponding structures and/or materials described herein and equivalents thereof.

In various other aspects, a system in accordance with the present disclosure may include means for enhancing image permanence, means for enabling the means for enhancing image permanence, and means for using the means for enhancing image permanence, all of the means for enhancing image permanence, the means for enabling the means for enhancing image permanence, and the means for using the means for enhancing image permanence covering corresponding structures and/or materials described herein and equivalents thereof In yet various other aspects, a method in accordance with the present disclosure may include steps for enhancing image permanence and steps for enabling the steps for enhancing image permanence, both the steps for enhancing image permanence and the steps for enabling the steps for enhancing image permanence covering corresponding acts described herein and equivalents thereof.

The particular embodiments are illustrative only, as the subject matter may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments may be altered or modified and all such variations are considered within the scope and spirit of the subject matter.

What is claimed is:

1. A method for enhancing image permanence, the method comprising:

applying an image to a sheet of a medium using a system comprising at least one photoreceptor, at least one fuser, at least one inverter, and at least one duplex path loop operatively connecting an output of the at least one fuser with an input to the at least one photoreceptor; and fusing the sheet of the medium at least twice using the at least one fuser before any other image is applied to the sheet of the medium.

2. The method of claim 1, wherein applying the image to the sheet of the medium further comprises applying the image to the sheet of the medium using the at least one photoreceptor before fusing the sheet of the medium using the at least one fuser.

3. The method of claim 2, wherein after fusing the sheet of the medium using the at least one fuser, the sheet of the medium is not inverted by bypassing the at least one inverter.

4. The method of claim 3, wherein after bypassing the at least one inverter, the image is not applied again to the sheet of the medium by the at least one photoreceptor before fusing the sheet of the medium again using the at least one fuser.

5. The method of claim 4, wherein the at least one duplex path loop is used to convey the sheet of the medium to the at least one fuser.

6. The method of claim 4, wherein the at least one duplex path loop is not used to convey the sheet of the medium to the at least one fuser.

7. The method of claim 1, wherein applying the image to the sheet of the medium further comprises applying the image to the sheet of the medium using the at least one photoreceptor after fusing the sheet of the medium using the at least one fuser.

8. The method of claim 7, wherein after fusing the sheet of the medium using the at least one fuser, the sheet of the medium is inverted using the at least one inverter.

9. The method of claim 8, wherein after using the at least one inverter, the image is applied to the sheet of the medium by the at least one photoreceptor before fusing the sheet of the medium again using the at least one fuser.

10. The method of claim 9, wherein the at least one duplex path loop is used to convey the sheet of the medium to the at least one fuser.

11. A method for enhancing image permanence, the method comprising:

applying an image to a sheet of a medium using a system comprising at least two photoreceptors, at least two fusers, and at least one inverter; and fusing the sheet of the medium at least twice using the at least two fusers before any other image is applied to the sheet of the medium.

12. The method of claim 11, wherein applying the image to the sheet of the medium further comprises applying the image to the sheet of the medium using one of the at least two photoreceptors before fusing the sheet of the medium using either of the at least two fusers.

13. The method of claim 12, wherein after fusing the sheet of the medium using one of the at least two fusers, the sheet of the medium is not inverted by bypassing the at least one inverter.

14. The method of claim 13, wherein after bypassing the at least one inverter, the image is not applied again to the sheet of the medium by either of the at least two photoreceptors before fusing the sheet of the medium again using one of the at least two fusers.

15. The method of claim 11, wherein applying the image to the sheet of the medium further comprises applying the image to the sheet of the medium using one of the at least two photoreceptors after fusing the sheet of the medium using either of the at least two fusers.

16. The method of claim 15, wherein after fusing the sheet of the medium using one of the at least two fusers, the sheet of the medium is not inverted by bypassing the at least one inverter.

17. The method of claim 16, wherein after bypassing the at least one inverter, the image is applied to the sheet of the medium by either of the at least two photoreceptors before fusing the sheet of the medium again using one of the at least two fusers.

18. The method of claim 15, wherein after fusing the sheet of the medium using one of the at least two fusers, the sheet of the medium is inverted using the at least one inverter.

19. The method of claim 18, wherein after using the at least one inverter, the image is applied to the sheet of the medium by one of the at least two photoreceptors before fusing the sheet of the medium again using one of the at least two fusers.

20. A system for enhancing image permanence, the system comprising:

at least one photoreceptor arranged to apply an image to a sheet of a medium;

at least one fuser arranged to fuse the sheet of the medium;

at least one inverter arranged to invert the sheet of the medium; and a controller arranged to control the at least one photoreceptor, the at least one fuser, and the at least one inverter to fuse the sheet of the medium twice using the at least one fuser before any other image is applied to the sheet of the medium.

* * * * *